US010392891B1

(12) United States Patent
Pruitt et al.

(10) Patent No.: US 10,392,891 B1
(45) Date of Patent: Aug. 27, 2019

(54) TOP POT ASSEMBLY

(71) Applicants: Grant Pruitt, Fort Smith, AR (US); Cris Braun, Van Buren, AR (US)

(72) Inventors: Grant Pruitt, Fort Smith, AR (US); Cris Braun, Van Buren, AR (US)

(73) Assignee: PRUITT TOOL & SUPPLY CO., Fort Smith, AR (US)

( * ) Notice: Subject to any disclaimer, the term of this patent is extended or adjusted under 35 U.S.C. 154(b) by 275 days.

(21) Appl. No.: 15/050,206

(22) Filed: Feb. 22, 2016

Related U.S. Application Data

(63) Continuation-in-part of application No. 14/076,096, filed on Nov. 8, 2013, now Pat. No. 9,267,350, which is a continuation of application No. 12/804,107, filed on Jul. 14, 2010, now abandoned.

(51) Int. Cl.
*E21B 33/02* (2006.01)
*E21B 33/06* (2006.01)

(52) U.S. Cl.
CPC ..... *E21B 33/06* (2013.01)

(58) Field of Classification Search
CPC ..... E21B 33/085
See application file for complete search history.

(56) References Cited

U.S. PATENT DOCUMENTS 3,387,851 A * 6/1968 Edward ..... E21B 33/085 277/318
5,647,444 A * 7/1997 Williams ..... E21B 33/085 166/84.1
8,286,734 B2 * 10/2012 Hannegan ..... E21B 7/02 166/84.1
9,267,350 B1 * 2/2016 Pruitt ..... E21B 33/085

* cited by examiner

*Primary Examiner* — D. Andrews
(74) *Attorney, Agent, or Firm* — Schrantz Law Firm, PLLC; Stephen D. Schrantz

(57) ABSTRACT

An improved top pot assembly utilizes an attachment body for attaching the rubber to a bearing assembly for rotation with the inner barrel. The attachment body simplifies the replacement of the rubber on the drilling assembly. The attachment body provides a guide that slopes downward into the central aperture and the bore to guide the mandrel and drilling string towards the bore. The attachment body also provides a stripper receiver for attachment of the rubber to the attachment body. The attachment body attaches to the housing which attaches to the bearing assembly for rotation of the rubber and the inner barrel.

20 Claims, 15 Drawing Sheets

TOP POT ASSEMBLY

CROSS-REFERENCE TO RELATED APPLICATIONS

This application is a continuation in part of U.S. patent application Ser. No. 14/076,096 filed on Nov. 8, 2013 entitled TOP POT ASSEMBLY which is a continuation of U.S. patent application Ser. No. 12/804,107 filed on Jul. 14, 2010 entitled TOP POT ASSEMBLY.

This application is related to U.S. patent application Ser. No. 12/072,929 filed on Feb. 29, 2008 entitled DUAL RUBBER CARTRIDGE and U.S. patent application Ser. No. 12/074,151 filed on Feb. 29, 2008 entitled EXTENDED WEAR BALL LOCK FOR ROTATING HEAD.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

In well drilling, with a rotary drilling rig, the drill bit and drilling pipe receive rotary motion from power equipment located on the surface. Below the drilling floor, at the ground surface, an assembly known as a rotating head allows the circulation of various fluids used in the drilling. The present invention relates to a top pot assembly. The top pot assembly allows for rotation of the top pot with a driver, including but not limited to a Kelly driver, or without the Kelly driver.

In well drilling, with a rotary drilling rig, the drill bit and drilling pipe receive rotary motion from power equipment located on the surface. Below the drilling floor, at the ground surface, there is usually an assembly known as a rotating head that allows the circulation of various fluids used in the drilling. Early drilling heads employed a single rubber to divert the flow of drilling fluid away from the rig floor. The rubber was fixedly mounted within the drilling head and the drill string rotated and moved longitudinally through the rubber as the rubber sealed against the string. The action of the drill string caused considerable wear on the rubber requiring frequent replacement. To reduce the abrasive wear, the rubber was rotated with the drill string to maintain sealing contact. However, a drill string typically includes various diameter sections. For example, the drill collars joining sections of drill string have a greater diameter than the drill pipe itself. Thus, the rubber was sized to maintain sealing contact with the drill pipe or the smallest diameter component which traveled through the drilling head.

Because of the different diameters of the drill string, the rubber needed to be rigid enough to withstand the pressures of the drilling fluid yet resilient enough to maintain a seal on the drill collars as the drill collars passed through the drilling head and thereafter return to the original configuration to seal against the smaller diameter drill pipe. The operating cycle of the rubber was directly proportional to the number of drill collars which passed through the single rubber since the rubber would not return to its original sealing diameter.

Drilling heads typically include a stationary body, often referred to as a bowl. The stationary body houses a rotatable spindle, commonly referred to as a bearing assembly. A Kelly drive or top drive unit rotates the rotatable spindle. One or more seals or packing elements, often referred to as stripper packers or stripper rubber assemblies, is carried by the spindle to seal the drilling head.

As modern wells are drilled ever deeper, or into certain geological formations, very high temperatures and pressures may be encountered on the surface at the drilling head. These rigorous drilling conditions pose increased risks to rig personnel from accidental scalding, burns or contamination by steam, hot water and hot, caustic well fluids. There is a danger of serious injury to rig workers when heavy tools are used to connect a stripper rubber assembly to the drilling head. Accordingly, such a connection should be made quickly and achieve a fluid tight seal.

Rotation of respective rotating components of drilling head is facilitated through a bearing assembly through which the drill string rotates relative to the stationary bowl or housing in which the bearing assembly is seated.

Pressure control is achieved by means of one or more stripper rubber assemblies connected to the bearing assembly and compressively engaged around the drill string to form a seal against the drill string. At least one stripper rubber assembly rotates with the drill string. The rubber presses against the drill string to achieve a fluid-tight seal. Stripper rubber assemblies connect to the drilling head to establish and help maintain a pressure control seal around the drill string.

Present day drilling operations are extremely expensive. An effort to increase the overall efficiency of the drilling operation while minimizing expense requires the essentially continuous operation of the drilling rig. Thus, it is imperative that downtime be minimized to reduce the nonproductive time.

In this regard, there is a need for improved sealing of the rotating head with the rubbers to maximize the useful life of the bearings. There is also a need to minimize nonproductive time through the changing out and replacing the stripper rubber elements.

A primary feature of the top pot assembly of the present invention includes improved sealing of the drill string. The top pot assembly provides a driving head that receives the Kelly driver for rotation of the top pot and inner barrel with the drill string. Further, the top pot assembly simplifies the process of removing and installing the rubber that seals and rotates with the drill string. The present invention also simplifies the process of removing and installing a top rubber. The top pot assembly of the present invention provides simple removal such that a user can easily replace the rubber. Further, the present invention seals on the Drill pipe, Kelly, collars, etc. to prevent debris from escaping the well bore and reduce risk factors involved with rig/drilling operations.

II. Description of the Known Art

Patents and patent applications disclosing information relevant to rotating heads are disclosed below. These patents and patent applications are hereby expressly incorporated by reference in their entirety.

U.S. Pat. No. 4,511,193 (the '193 patent) issued to Geczy on Apr. 16, 1985 teaches a combined radial and thrust bearing assembly for a down-hole drilling assembly to journal a shaft, mounting the drill bit, in a housing. The bearing assembly is used between a down-hole fluid powered motor and a drill bit for drilling oil wells, for example. The bearing assembly includes cooperative pairs of upper and lower inner races located on the shaft for mutual rotation. Each of the inner races includes a pair of interchangeable toroidal tracks. Cooperative pairs of upper and lower outer races are fixed against rotation in the housing. Each outer race has a pair of interchangeable toroidal tracks to selectively cooperate with the tracks of the inner races to define a toroidal channel to receive a number of bearing balls. Spring means are disposed between the upper and lower pairs of outer races and the housing and between the upper and lower pairs of outer races to provide a compliant coupling for the even distribution of radial and upwardly and downwardly directed thrust loads between the races and balls and eventual transfer to the housing. Drilling fluid is circulated through the bearing assembly for cooling and lubrication.

U.S. Pat. No. 5,213,158 ("the '158 patent") issued to Bailey, et al. on May 25, 1993 teaches a drilling head with dual rotating stripper rubbers designed for high pressure drilling operations ensuring sealing under the extreme conditions of high flow or high pressure wells such as horizontal drilling. The dual stripper rubbers taught by the '158 patent seal on the same diameter yet are manufactured of different materials for different sealing functions. The lower stripper rubber is manufactured from a more rigid, abrasive resistant material to divert the flow from the well. The upper stripper rubber is manufactured of a softer sealing material that will closely conform to the outer diameter of the drill string thereby preventing the flow of fluids through the drilling head.

U.S. Pat. No. 5,647,444 issued to Williams on Jul. 15, 1997 discloses a rotating blowout preventor having at least two rotating stripper rubber seals which provide a continuous seal about a drilling string having drilling string components of varying diameter. A stationary bowl is designed to support a blowout preventor bearing assembly and receives a swivel ball that cooperates with the bowl to self-align the blowout preventor bearing assembly and the swivel ball with respect to the fixed bowl. Chilled water is circulated through the seal boxes of the blowout preventor bearing assembly and liquid such as water is pumped into the bearing assembly annulus between the stripper rubbers to offset well pressure on the stripper rubbers.

U.S. Pat. No. 5,662,181 issued to Williams et al. on Sep. 2, 1997 ("the '181 patent") teaches a rotating blowout preventor having at least two rotating stripper rubber seals which provide a continuous seal about a kelly or drilling string having drilling string components of varying diameter. A stationary housing of the '181 patent is designed to support a bearing assembly and a clamp cooperates with the housing to secure the bearing assembly in the housing.

U.S. Pat. No. 7,198,098 issued to Williams on Apr. 3, 2007 ("the '098 patent") teaches a connector system for connecting parts of an apparatus. The '098 patent teaches a first part having one or more bayonet connectors and one or more retention pin receptacles cooperatively mates to a second part having one or more mating bayonet connectors. The second part taught by the '098 patent further provides one or more retention pin bores. The first and second parts taught by the '098 patent assemble to form a bayonet connection such that at least one pin retention bore aligns with at least one retention pin receptacle. The '098 patent teaches that at least one retention pin assembly disposed through the at least one pin retention bore selectively engages the retention pin receptacle to secure the connection of the first part to the second part of the apparatus.

U.S. Publication No. 20090057024 to Williams on Mar. 5, 2009 ("the '024 publication") teaches an upper stripper rubber canister system that comprises a canister body and a canister body lid. The canister body taught by the '024 publication includes an upper end portion, a lower end portion and a central passage extending therebetween. The central passage taught by the '024 publication is configured for having a stripper rubber assembly disposed therein. The '024 publication teaches an upper end portion of the body that includes a plurality of bayonet connector structures. The canister body lid taught by the '024 publication includes an exterior surface, an upper end portion, a lower end portion and a central passage extending between the end portions thereof. The exterior surface taught by the '024 publication is configured for fitting within the central passage of the canister body. The canister body lid includes a plurality of bayonet connector structures integral with its exterior surface. Each canister body lid bayonet connector structure taught by the '024 publication is configured for being engaged with one of the canister body bayonet connector structures for interlocking the canister body lid with the canister body.

SUMMARY OF THE INVENTION

The top pot assembly of the present invention includes a housing that houses the rubber. The housing attaches to an inner barrel of a rotating head assembly. As a result, the rubber will also rotate with the rotating head assembly thus maintaining the seal with the drill string to divert the drilling fluid from the well to the outlet flange.

The rubber has a diameter to seal against the drill string. The rubber maintains a constant seal of the drill pipe to prevent debris and other contaminants from escaping the well bore. The present invention utilizes a top pot assembly that secures a rubber in contact with the inner barrel for rotation with the inner barrel.

The present invention reduces the downtime of the drilling rig by reducing time expended replacing the rubber. Known rotating heads require a user to individually remove each rubber after halting operation of the drilling rig. Known rotating heads also require specialized tools to change a rubber. Thus, known rotating heads increased downtime of the drilling and reduced the operating time of the drilling rig to increase expenses of the drilling operation.

The present invention reduces the number of steps and requirements needed to replace the rubber. Thus, the present invention increases the operation of the drilling rig.

The quick attachment of the present invention also allows attachment of the rubber. By utilizing a quick attachment system, the present invention reduces the amount of time uninstalling a top rubber and reinstalling the top rubber. Therefore, the quick attachment system of the present invention reduces downtime of the drilling rig.

The attachment body of the present invention eliminates the need for the kelly drive, thus creating additional work space above the RCD.

The attachment body assists with insertion of the drill string through the inner barrel and a rubber found in the RCD. The attachment body aligns the drill string with the inner barrel and rubber for insertion through the inner barrel and the rubber. The attachment body positions the drill string within the rubber for rotation of the inner barrel with the drill string. The contact of the drill string with the rubber caused by the attachment body rotates the inner barrel with the drill string. The top drive guide may be used either in a low pressure head or a high pressure head.

Other objects, features, and advantages of the invention will be apparent from the following detailed description taken in connection with the accompanying drawings.

It is an object of the present invention to provide an improved rotating head that enables ease of use for the end user.

Another object of the present invention is to allow more efficient assembly and disassembly of the rotating head assembly.

Another object of the present invention is to increase efficiency of the assembly and disassembly of the rotating head assembly to decrease the amount of down time due to necessary repairs of the rotating head assembly.

Another object of the present invention is to increase the life of bearings, seals, and other internal components by preventing debris from entering the bearings, seals, and other internal components.

Another object of the present invention is to allow for the trouble free operation of the rotating head assembly for the rig personnel.

Another object of the present invention is to create a safer work environment for rig personnel.

Another object of the present invention is to simplify the method of assembly of the rotating head assembly.

Another object of the present invention is to allow a quick change system that will save valuable time on the rig, thus eliminating time in which the rig is inoperable to reduce nonproductive time.

In addition to the features and advantages of the rotating head assembly according to the present invention, further advantages thereof will be apparent from the following description in conjunction with the appended drawings.

These and other objects of the invention will become more fully apparent as the description proceeds in the following specification and the attached drawings. These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
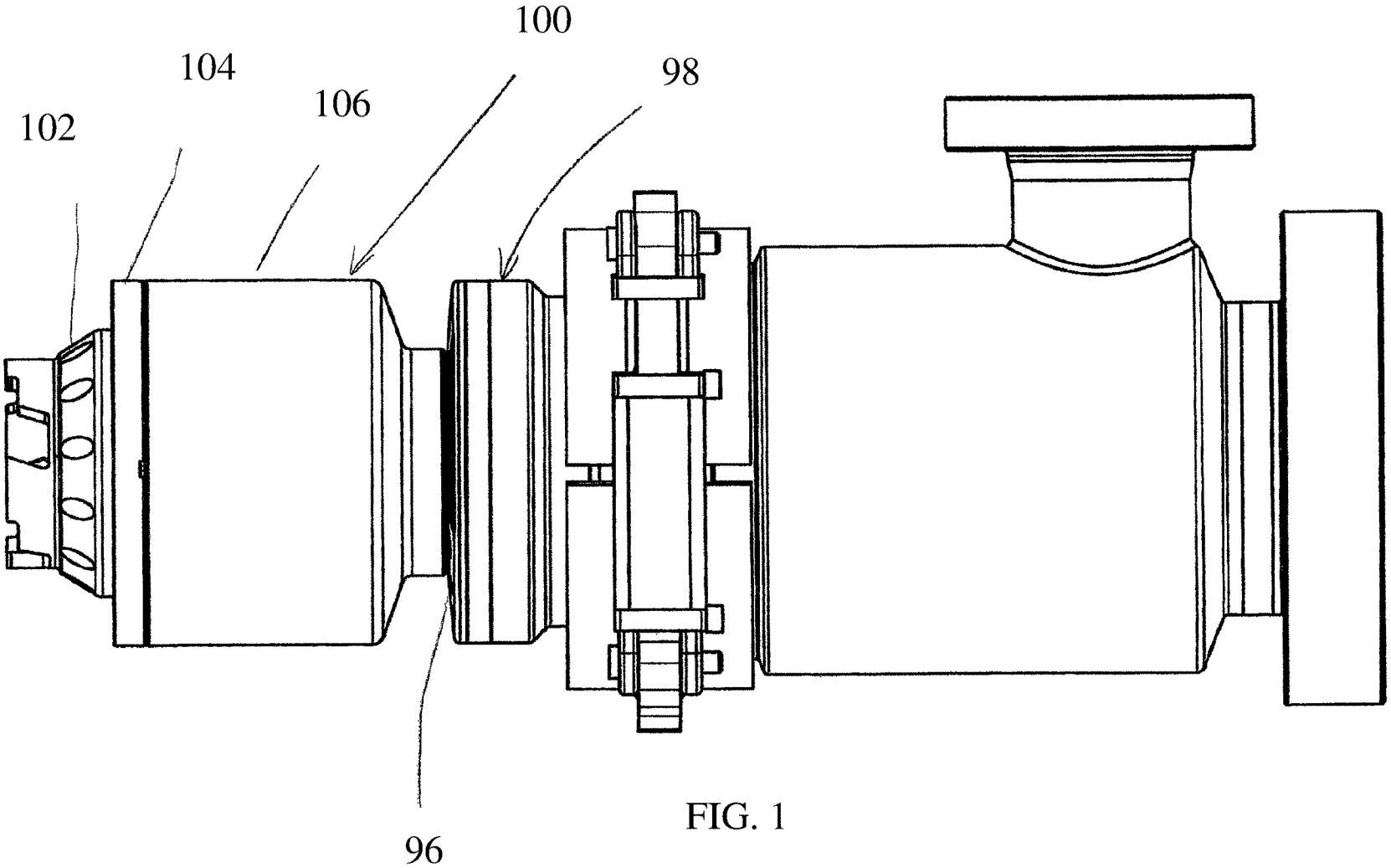
FIG. 1 is an environmental view showing one embodiment of the present invention.

The present invention relates to rotating heads for oil and gas wells and more particularly, to an improved top pot assembly 100 that utilizes an attachment body 104 for attaching the rubber and the driving head to a bearing assembly for rotation with the inner barrel. Referring to FIG. 1, the top pot assembly of the present invention is generally illustrated by reference numeral 100. The top pot assembly 100 is characterized by a driving head 102, an attachment body 104, a rubber 108, and a housing 106. The housing 106 attaches to the inner barrel 96 of the bearing assembly 98. The attachment body 104 simplifies the replacement of the rubber 108 on the drilling assembly. The attachment body 104 provides a driving receiver for attachment of the driving head 102 to the attachment body 104. A stripper receiver of attachment body 104 secures the rubber 108 to the attachment body 104. The attachment body 104 secures to the housing 106. The housing 106 attaches to the inner barrel 96 for rotation of the driving head 102, the rubber 108, and the inner barrel 96. The top pot assembly provides a string aperture to allow passage of a drilling string through the top pot assembly.

Figure 2:
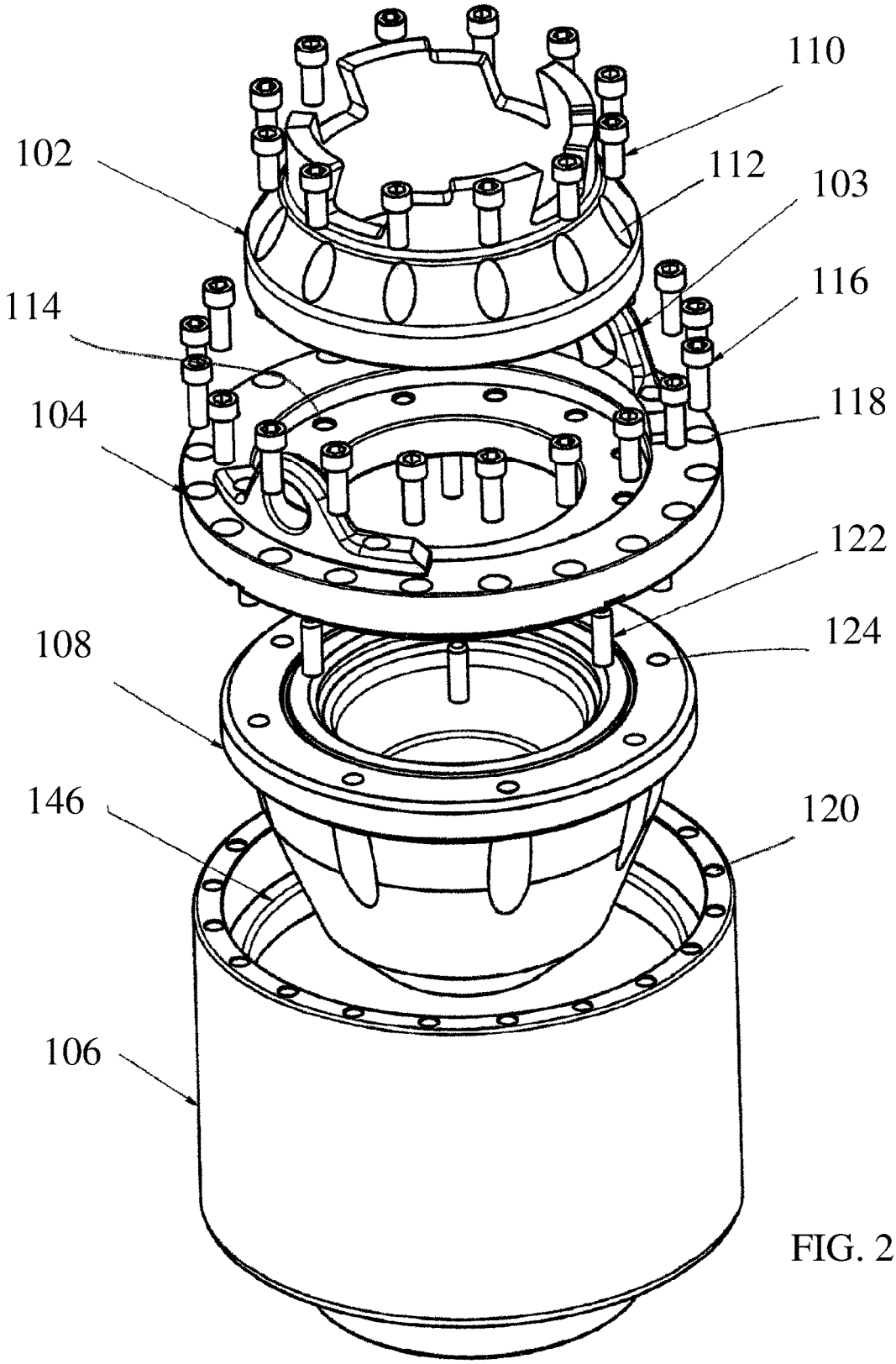
FIG. 2 is an exploded view showing one embodiment of the present invention.

FIG. 2 shows an exploded view of the top pot assembly 100 and the attachment of the components of the top pot assembly 100. Each component of the top pot assembly will be described in greater detail below. Driving head 102 accepts a Kelly driver that rotates the driving head 102, the attachment body 104, the rubber 108, the housing 106 and inner barrel 96. Driving head 102 attaches to attachment body 104. Attachment body 104 provides a driver receiver on the interior of the upper side of attachment body 104. Driver head 102 attaches to the attachment body 104 at the driver receiver on the interior section of the upper side of attachment body 104. Fasteners 110, such as threaded fasteners, bolts, screws, socket head cap screws, or other known fasteners, secure the driver head 102 to attachment body 104. Fasteners 110 pass through fastener apertures 112 of driving head 102 to be secured in fastener apertures 114 of attachment body 104.

Fasteners 116, secure the attachment body 104 to housing 106. Fasteners 116, such as threaded fasteners, screws, bolts, socket head cap screws, or other known fasteners placed into the fastener apertures 118 of fastener surface 126 of attachment body 104 secure attachment body 104 to the housing 106. Fasteners 116 pass into fastener apertures 118 of attachment body 104 to be secured in fastener apertures 120 of housing 106. In one embodiment of the present invention, attachment body 104 secures to a housing 106, such as a top pot.

Figures 8, 9:
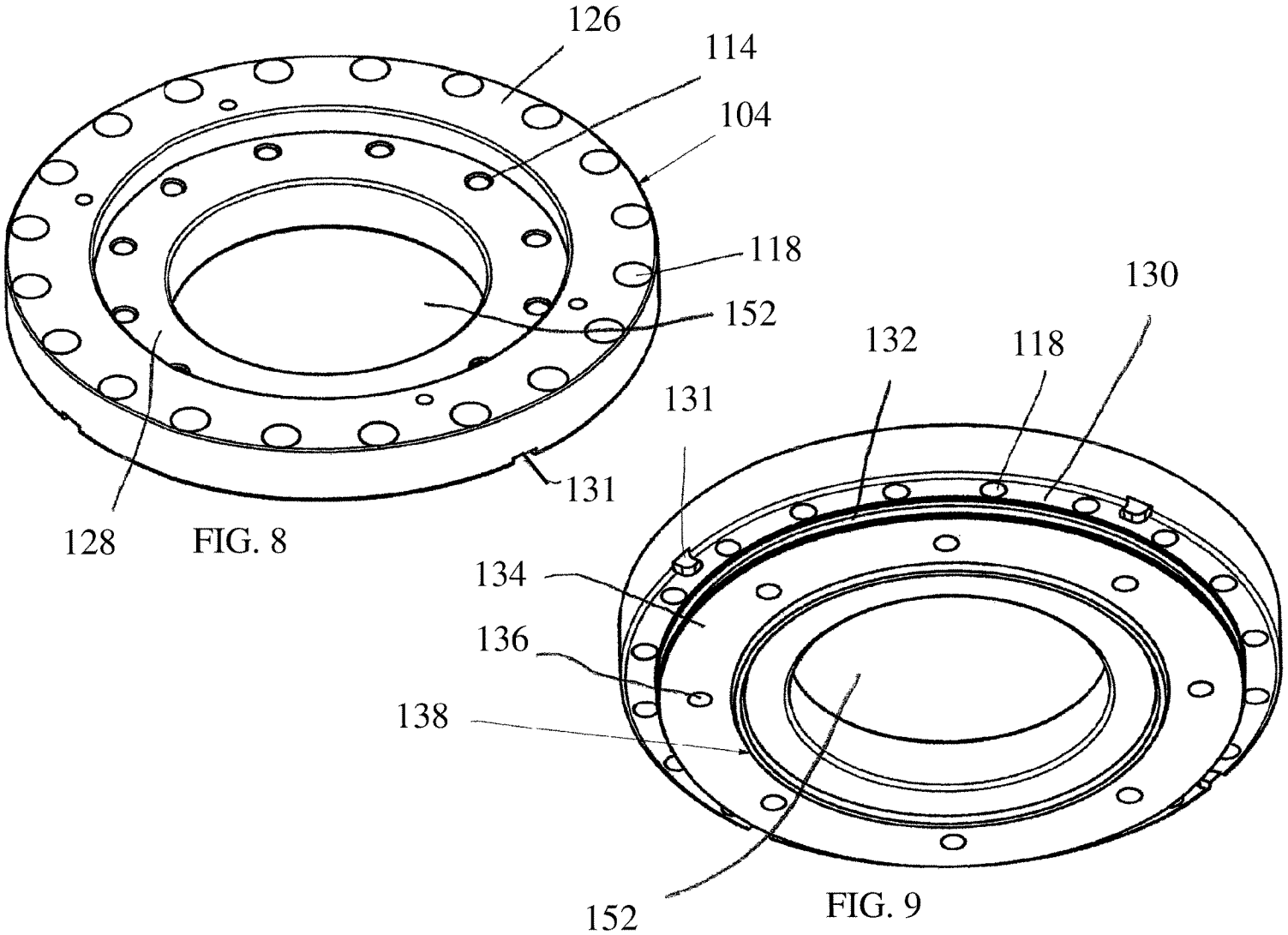
FIG. 8 is a top perspective view of the attachment body of the present invention.
FIG. 9 is a bottom perspective view thereof.

Referring to FIGS. 2 and 9, housing 106 and rubber 108 secure to the bottom side of attachment body 104. The exterior portion of the bottom side of attachment body 104 provides housing contact 130 for attachment of the attachment body 104 to housing 106. Fasteners 116 pass into attachment apertures 118 to secure within attachment apertures 120 of housing 106.

The bottom side of attachment body 104 also provides a stripper receiver 134 found on the bottom side of the attachment body 104 for attaching rubber 108 to attachment body 104. Stripper receiver 134 is located inward from the housing contact 130. In one embodiment, stripper receiver 134 extends below housing contact 130. Extender 132 extends below the housing contact 130 for placement of the stripper receiver 134 within housing 106 when attachment body 104 attaches to housing 106. Rubber 108 secures to the stripper receiver 134 of attachment body 104. Stripper receiver 134 positions rubber 108 within housing 108 to seal the housing 106. Fasteners 122, such as dowels, secure attachment body 104 to rubber 108. Fasteners 122 secure into fastener apertures 136 of attachment body 104 and fastener apertures 124 of rubber 108 to attach attachment body 104 to rubber 108.

Figure 5:
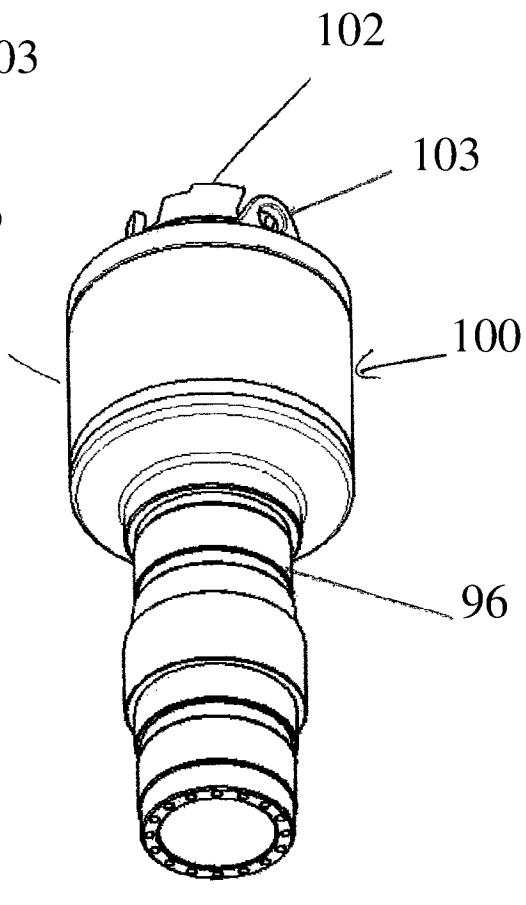
FIG. 5 is a bottom environmental view showing one embodiment of the present invention attached to an inner barrel.
Figure 4:
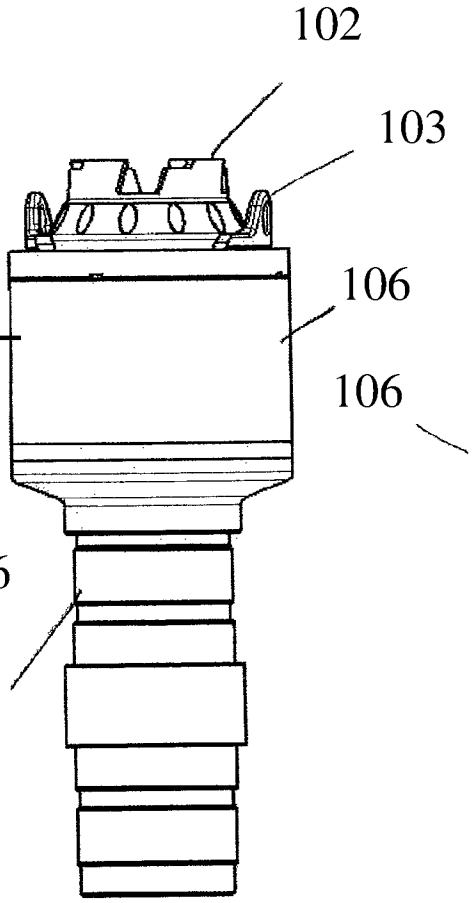
FIG. 4 is an environmental view showing one embodiment of the present invention attached to an inner barrel.
Figure 3:
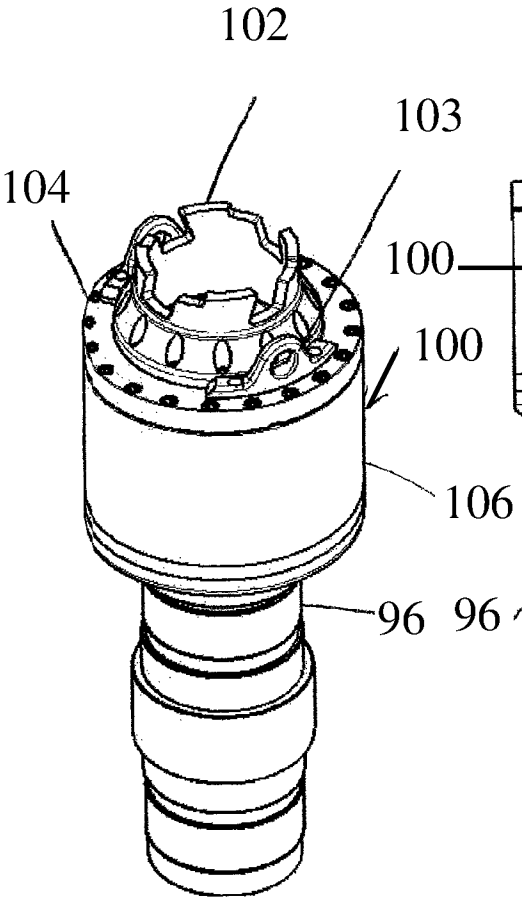
FIG. 3 is a top environmental view showing one embodiment of the present invention attached to an inner barrel.

FIGS. 3-5 show the attachment of housing 106 to inner barrel 96. Driving head 102 attaches to attachment body 104 which is secured to housing 106. Housing 106 also secures to inner barrel 96. The attachment of the components of the top pot assembly 100 with the inner barrel 96 translates rotation of the driving head 102 and the other components of the top pot assembly 100 into rotation of the inner barrel 96. Therefore, inner barrel 96 rotates with driving head 102. FIGS. 2-5 also show lift eye 103. Lift eye 103 bolts onto attachment body 104 to assist with the lifting of the top pot assembly 100 and the rotating assembly as a whole.

Figure 7:
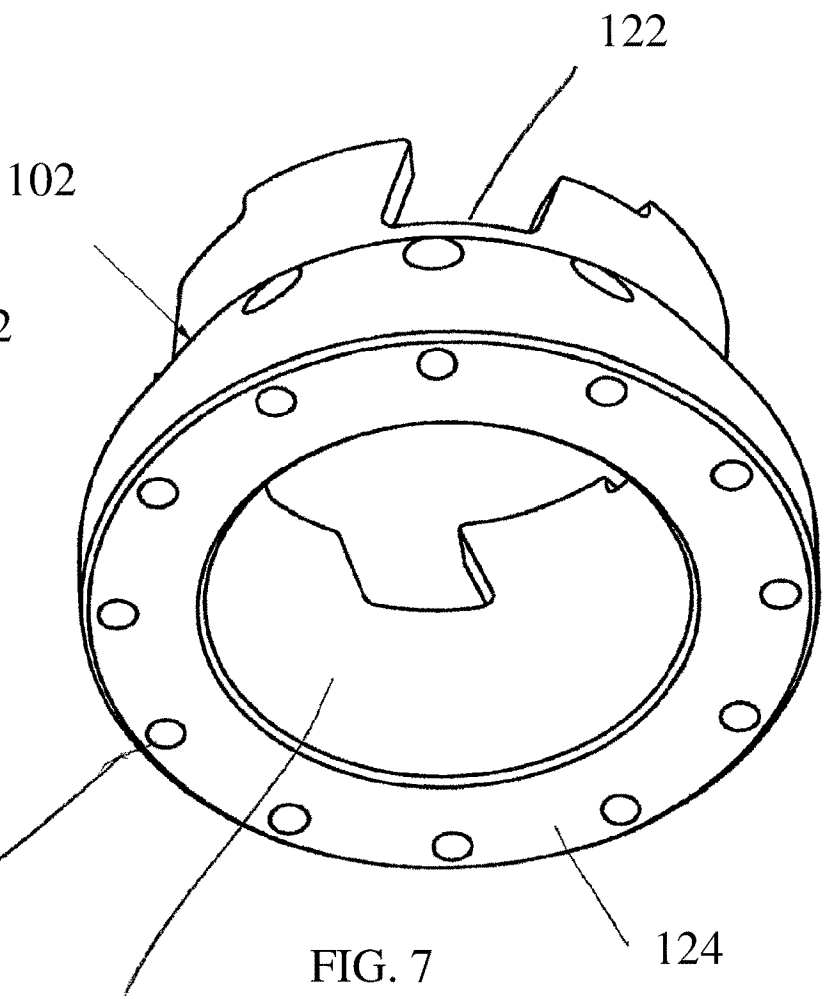
FIG. 7 is a bottom perspective view thereof.
Figure 6:
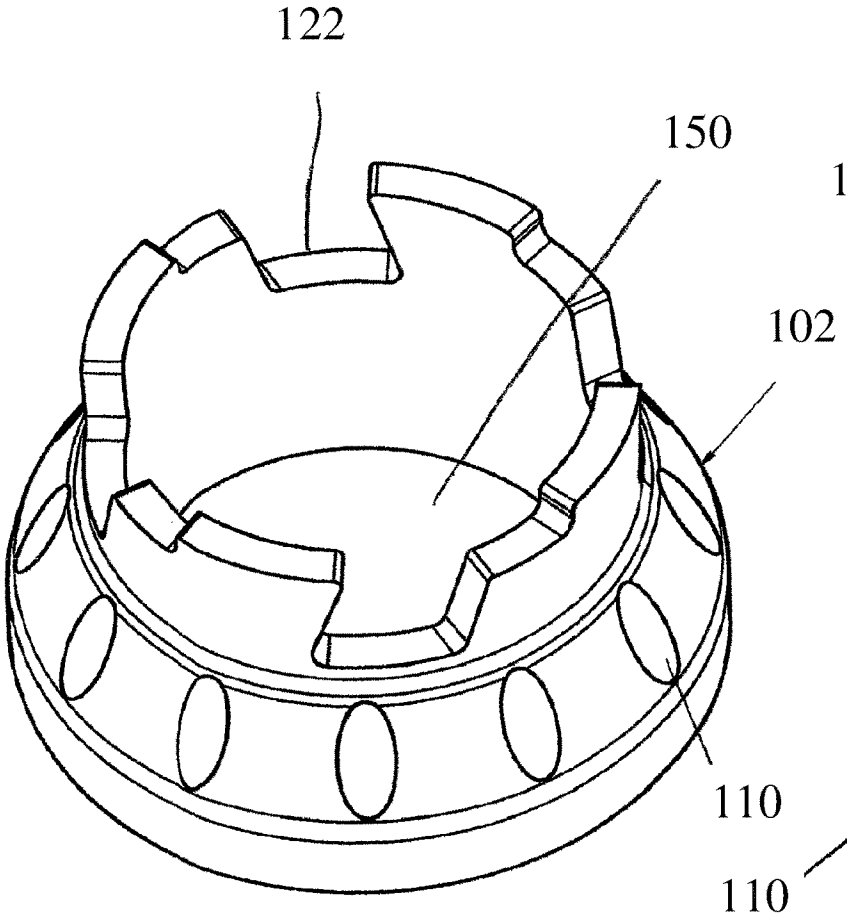
FIG. 6 is a top perspective view of the driving head of the present invention.

FIGS. 6 and 7 show a top perspective view and bottom perspective view of the driving head 102 of the present invention, respectively. FIGS. 6 and 7 show the ability to remove and replace the driving head 102. The ability to remove and replace driving head 102 reduces the nonproductive time and decreases costs of replacing the driving head 102. As driving head 102 wears or if driving head 102 is damaged, the user may remove the driving head 102 and install a new driving head 102. Therefore, the driving head 102 of the present invention eases the replacement of a damaged driving head. The removable driving head 102 of the present invention also provides a cost effective method of replacing a damaged driving head 102. Driving head 102 provides at least one receiving indention 122 for accepting the Kelly driver. A portion of the driver, including but not limited to a Kelly driver, interlocks with the receiving indention 122 to transfer the rotation of Kelly driver to the driving head 102. As described above, driving head 102 provides receiving apertures 110 for placement of fasteners 110 to secure driving head 102 to attachment body 104.

FIGS. 8 and 9 show a top perspective view and bottom perspective view of attachment body 104, respectively. Referring to FIGS. 2 and 8, the attachment of components of the top pot assembly 102 to attachment body 104 will be described in greater detail. Attachment body 104 provides a fastener surface 126 and driver receiver 128. Fastener surface 126 is located exterior to driver receiver 128. Fastener surface 126 provides a surface for securing fasteners 116. Fasteners 116, such as threaded fasteners, bolts, screws, or other known fasteners, pass into fastener apertures 118 of attachment body 104 to be secured within fastener apertures 120 of housing 106.

Continuing to refer to FIGS. 2 and 8, attachment body 104 also provides a driver receiver 128 on the interior of the upper side of attachment body 104. Driver head 102 attaches to the attachment body 104 at the driver receiver 128 on the interior section of the upper side of attachment body 104. Driver receiver 128 extends below fastener surface 126 for placement of driving head 102. The positioning of driver receiver 128 below fastener surface 126 assists in placement of driving head 102 when securing driving head 102 to attachment body 104. Fasteners 110 secure the driver head 102 to attachment body 104. Fasteners 110, such as threaded fasteners, bolts, screws, socket head cap screws, or other known fasteners, pass into fastener apertures 112 of driving head 102 to be secured within fastener apertures 114 of attachment body 104. In one embodiment of the present invention, driver receiver 128 extends up to one inch below fastener 126 for placement of driving head 102.

Attachment body 104 also provides adjustment aperture 131 that assists the user with installing and removing attachment body 104 from housing 106. The aperture found in the middle of attachment body 104 is sized in relationship to the size of inner barrel 96.

Figure 10:
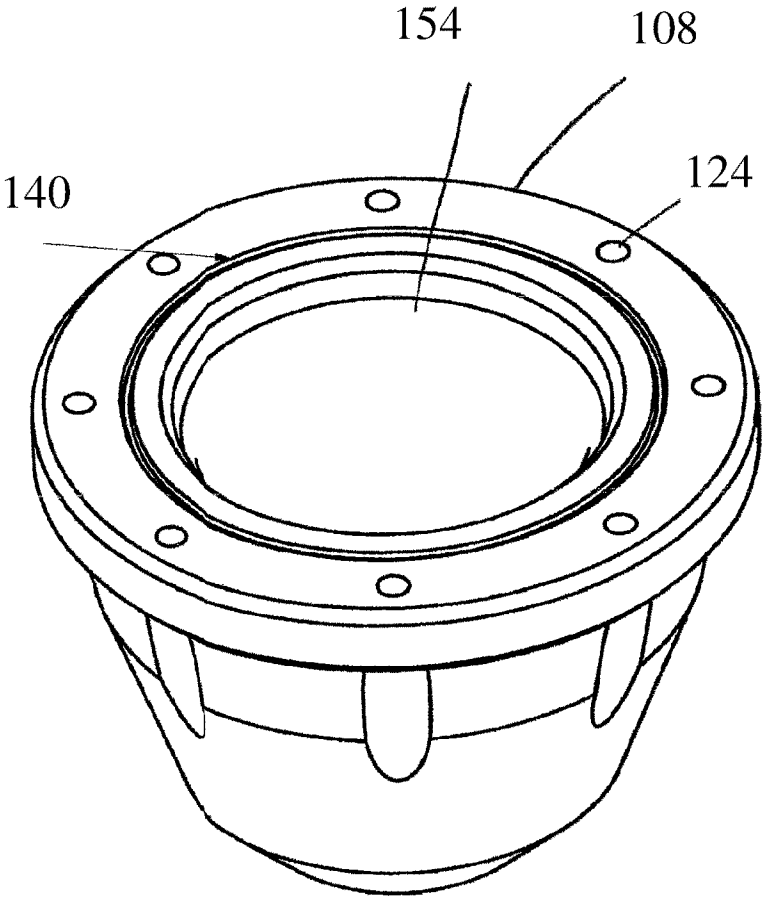
FIG. 10 is a top perspective view of the rubber of the present invention.

Referring to FIGS. 2, 9, and 10, housing 106 and rubber 108 secure to the bottom side of attachment body 104. The housing contact 130 found on the exterior portion of the bottom side of attachment body 104 enables attachment of the attachment body 104 to housing 106. As described above, fasteners 116 secure the attachment body 104 to housing 106. Fasteners 116 pass through attachment apertures 118 to secure within attachment apertures 120 of housing 106.

The bottom side of attachment body 104 also provides a stripper receiver 134 found on the bottom side of the attachment body 104 for attaching rubber 108 to attachment body 104. Stripper receiver 134 is located inward from the housing contact 130. In one embodiment, stripper receiver 134 extends below housing contact 130. Extender 132 extends below the housing contact 130 for placement of the stripper receiver 134 within housing 106 when attachment body 104 attaches to housing 106. Extender 132 also assists with the installation of attachment body 104 within housing 106. In one embodiment, stripper receiver 134 extends up to one inch below housing contact 130.

Stripper receiver 134 of attachment body 104 secures rubber 108 to the attachment body 104. Stripper receiver 134 positions rubber 108 within housing 108 to seal the housing 106. Fasteners 122, such as dowels, secure attachment body 104 to rubber 108. Other known fasteners may be used to attach rubber 108 to attachment body 104. Fasteners 122 align rubber 108 on stripper receiver 134 of attachment body 104 for sealing the drilling assembly. The attachment of rubber 108 on attachment body 104 by fasteners 122 also rotates rubber 108 with attachment body 104 and driving head 102. In one embodiment of the present invention, 8 0.625 dowels locate rubber 108 to attachment body 104.

Stripper receiver 134 may contain an o-ring located on the outer edge of extender 132. Extender 132 extends downwards into housing 106 such that the o-ring seals between the stripper receiver 134 and housing 106. The o-ring found on stripper receiver 134 forms a seal in housing 106 above housing lip 146.

Referring to FIGS. 2, 9, and 10, fasteners 122 align rubber 108 on stripper receiver 134. Fasteners 122 secure into fastener apertures 136 of attachment body 104 and fastener apertures 124 of rubber 108. Attachment body 104 provides sealing lip 138 for contact with sealing lip 140 of rubber 108. Fasteners 122 align rubber 108 on attachment body 104 such that sealing lip 138 of attachment body 104 aligns with sealing lip 140 of rubber 108. The alignment of sealing lip 138 of attachment body 104 and sealing lip 140 of rubber 108 seals the rubber 108 on stripper receiver 134.

Figure 11:
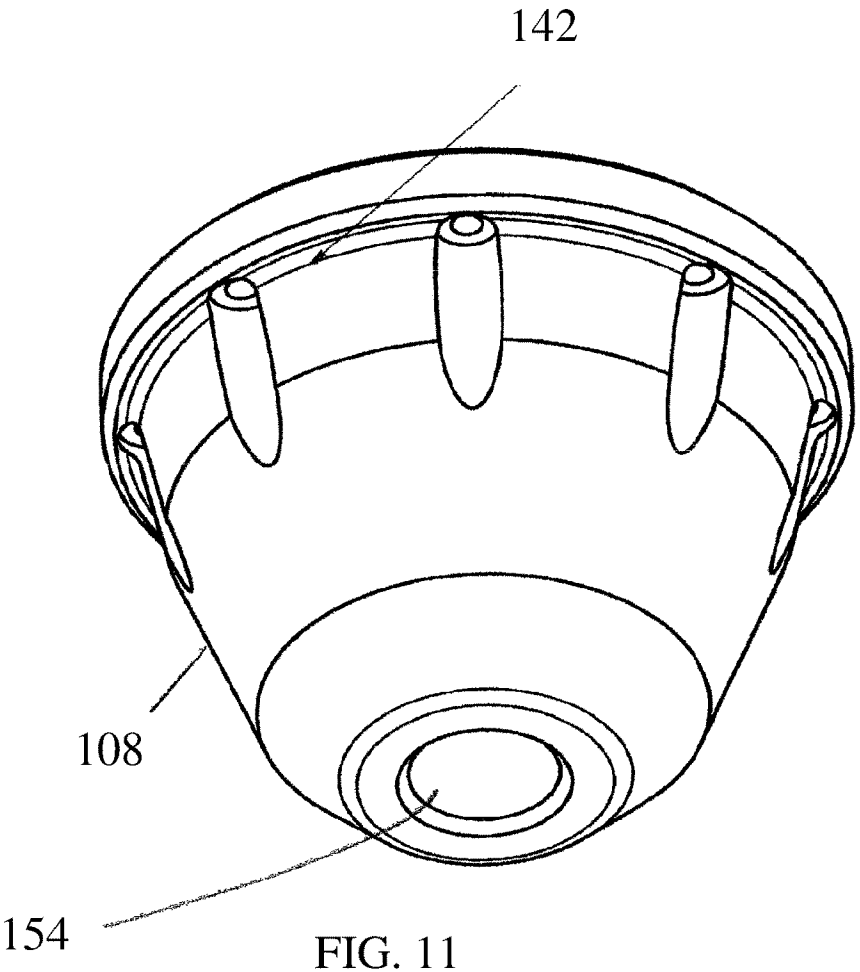
FIG. 11 is a bottom perspective view thereof.
Figure 12:
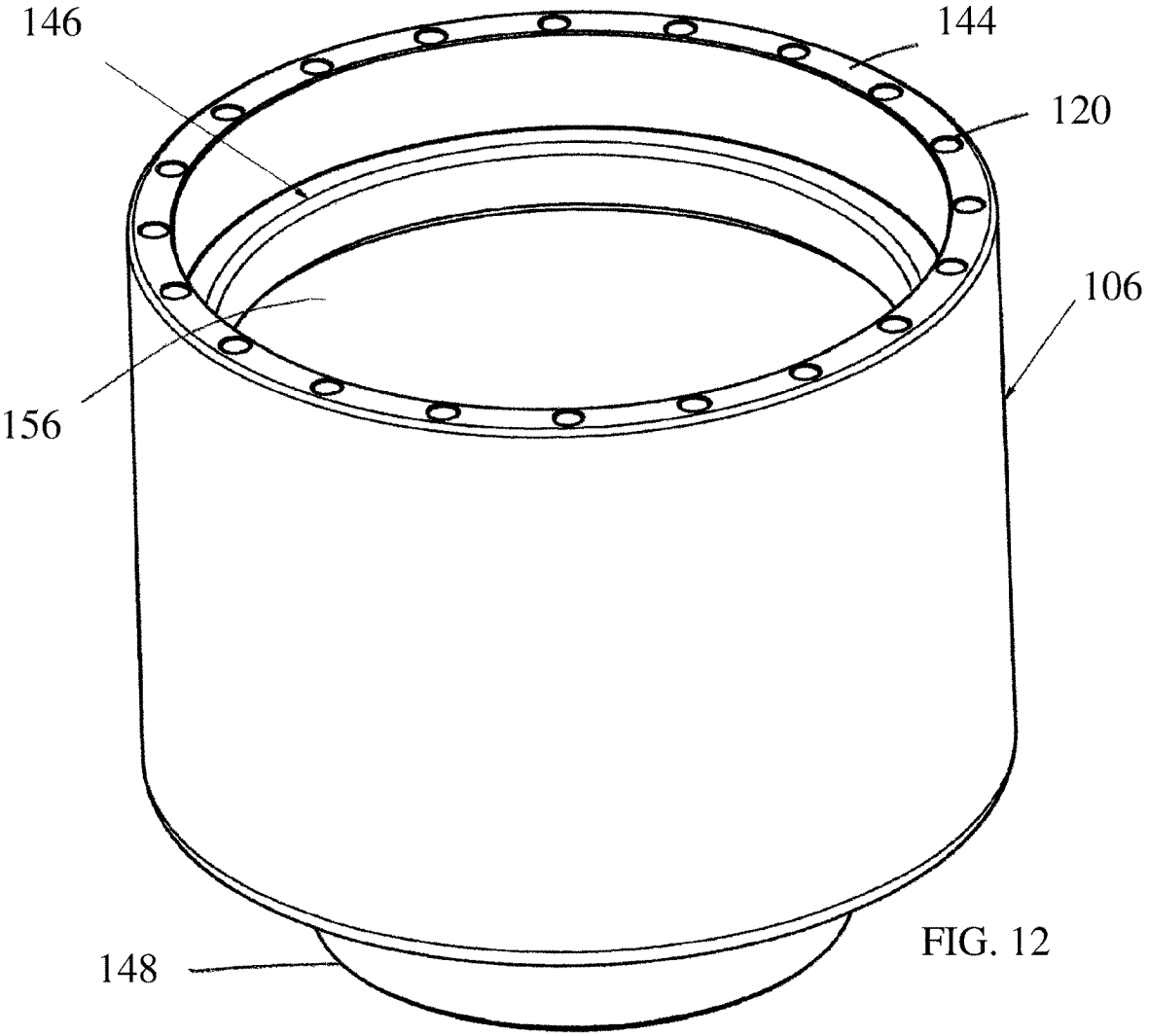
FIG. 12 is a perspective view of a housing of the present invention.
Figure 13:
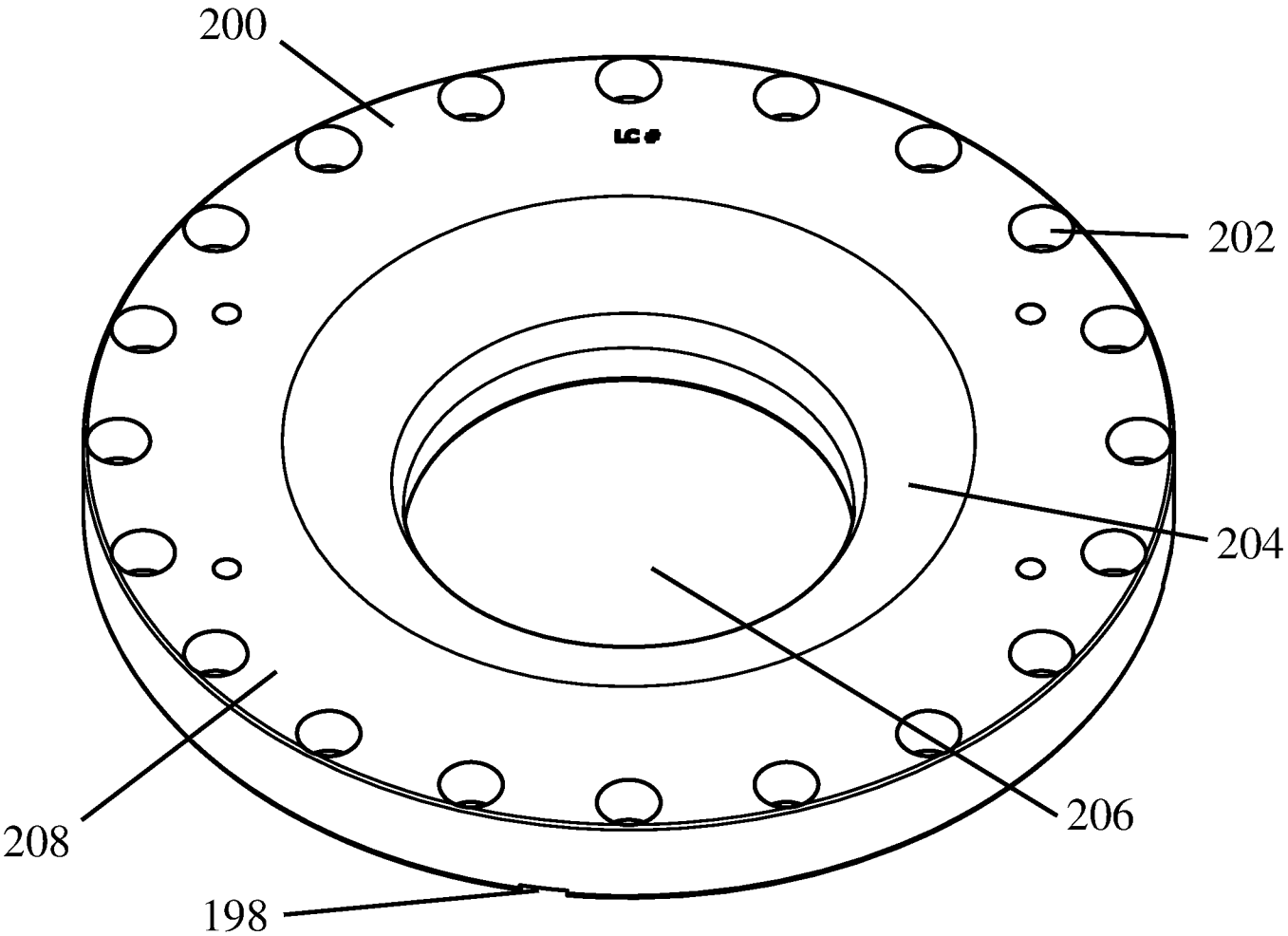
FIG. 13 is a top perspective view showing one embodiment of the present invention.

Referring to FIGS. 2, 11, and 12, the rubber 108 fits within the housing 106. As stated above, housing contact 130 of attachment body 104 abuts attachment surface 144 of housing 106. The stripper receiver 134 of attachment body 104 extends into housing 106 for placement of rubber 108 within housing 106. The rubber 108 extends into housing 106 such that rubber 108 abuts the housing lip 146 located inside of housing 106.

Housing 106 also provides a barrel attachment surface 148 for attachment of inner barrel 96 of the bearing assembly 98 as shown in FIGS. 3-5. In one embodiment not shown, barrel attachment surface 148 provides fastener apertures for attaching the inner barrel 96 to the housing 106. As described above, the attachment of the components of the top pot assembly 100 with the inner barrel 96 translates rotation of the driving head 102 and the other components of the top pot assembly 100 into rotation of the inner barrel 96. Therefore, inner barrel 96 rotates with driving head 102.

The top pot assembly allows passage of a drilling string through the string apertures found in the driving head 102, the attachment body 104, the rubber 108, and the housing 106. The string apertures are generally shown as reference numbers 150, 152, 154, and 156.

FIGS. 13-18 show another embodiment of an attachment body 200 for securing a rubber within housing 106, such as a top pot. Attachment body 200 can serve as a substitute for attachment body 104 in FIG. 2. Attachment body 200 provides a guide 204 that slopes vertically downward into aperture 206 located radially inward from fastener surface 208. Fasteners, such as the fasteners 116 shown in FIGS. 2 and 19-20 secure the attachment body 200 to the housing 106.

Attachment body 200 provides a fastener surface 208. Fastener surface 208 is located exterior to guide 204. Fastener surface 208 provides a surface for securing fasteners 116. Fasteners 116, such as threaded fasteners, bolts, screws, or other known fasteners, pass into fastener apertures 202 of attachment body 200 to be secured within fastener apertures 120 of housing 106 shown in FIGS. 2 and 12.

Attachment body 104 also provides adjustment aperture 198 to assist the user with installing and removing attachment body 200 from housing 106. The aperture found in the middle of attachment body 200 is sized in relationship to the size of inner barrel 96.

Figure 14:
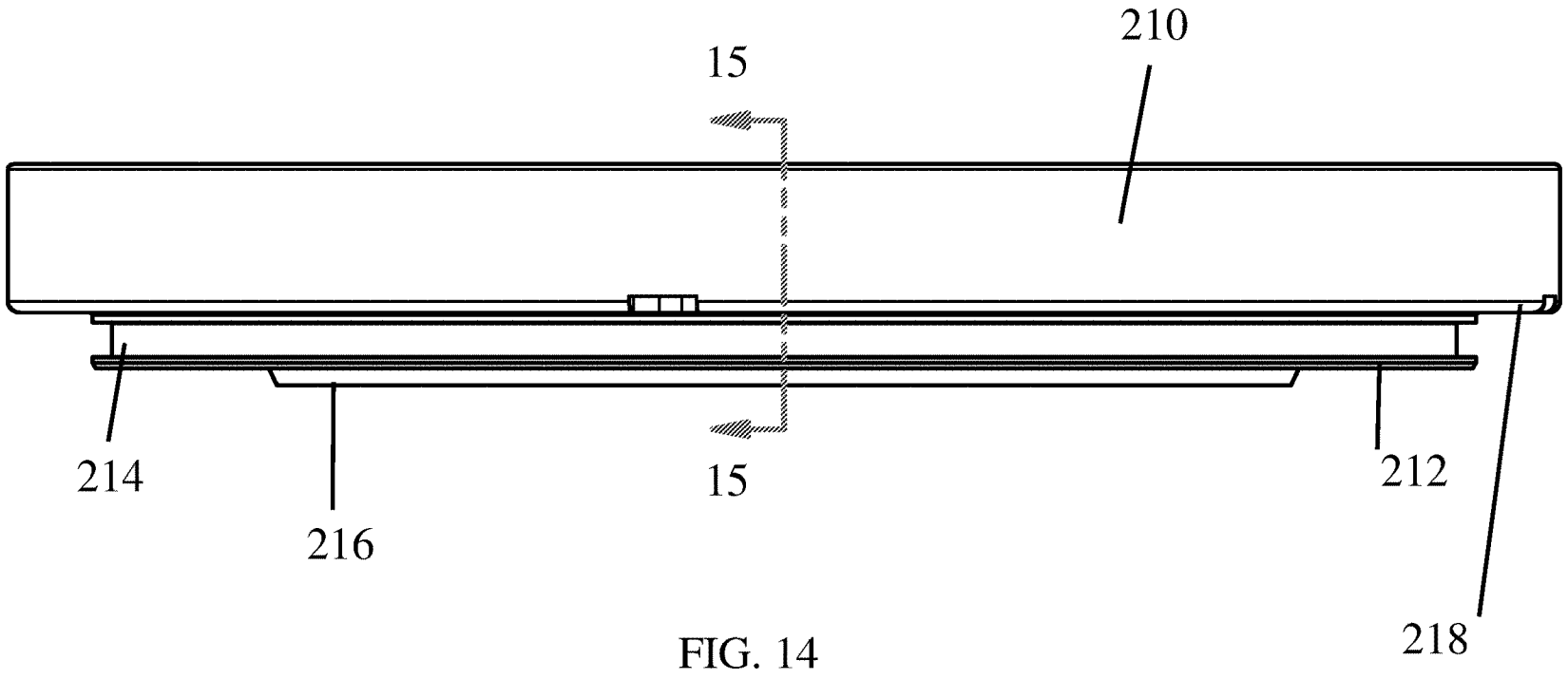
FIG. 14 is a side view thereof.
Figure 20:
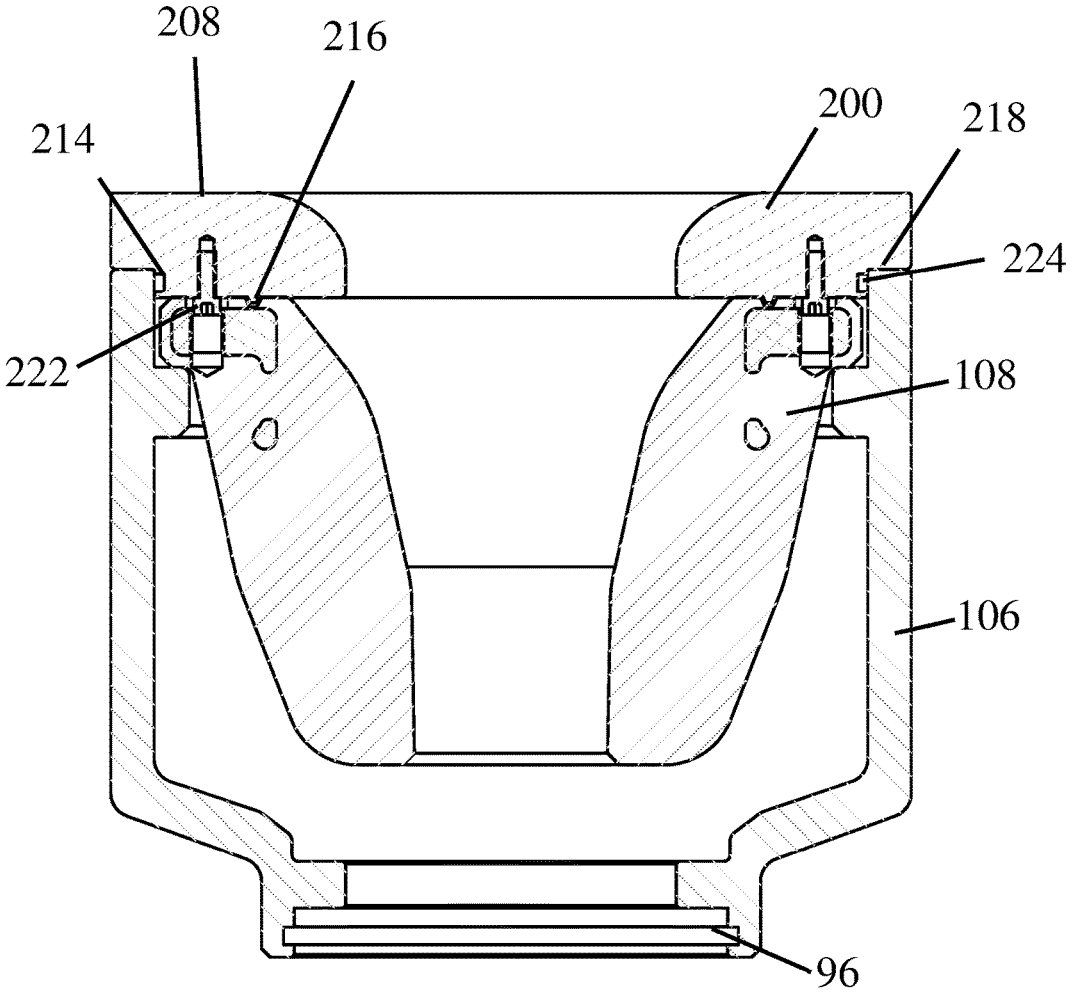
FIG. 20 is a sectional view thereof.

Referring to FIG. 14, attachment body 200 secures to housing 106. To seal between the attachment body 200 and housing 106, attachment body 200 provides seal receiver 214 that extends vertically below the housing contact 218. Seal receiver is located radially inward from housing 106 when attachment body 200 attaches to housing 106 as shown in FIG. 20. A seal placed on seal receiver 214 seals between the housing 106 and attachment body 200.

The attachment body 200 serves as a lid and a top drive guide. The attachment body 200 reduces the overall height of the RCD thus creating additional overhead space for the rig personnel. The attachment body 200 replaces the Kelly drive rotating the attachment body 200 through direct contact with the rotating drilling string.

The attachment body 200 protects the inner barrel while stabbing the mandrel through the inner barrel. The attachment of the attachment body 200 by fasteners 116 enables the users to quickly and easily attach and remove the attachment body 200.

Figure 15:
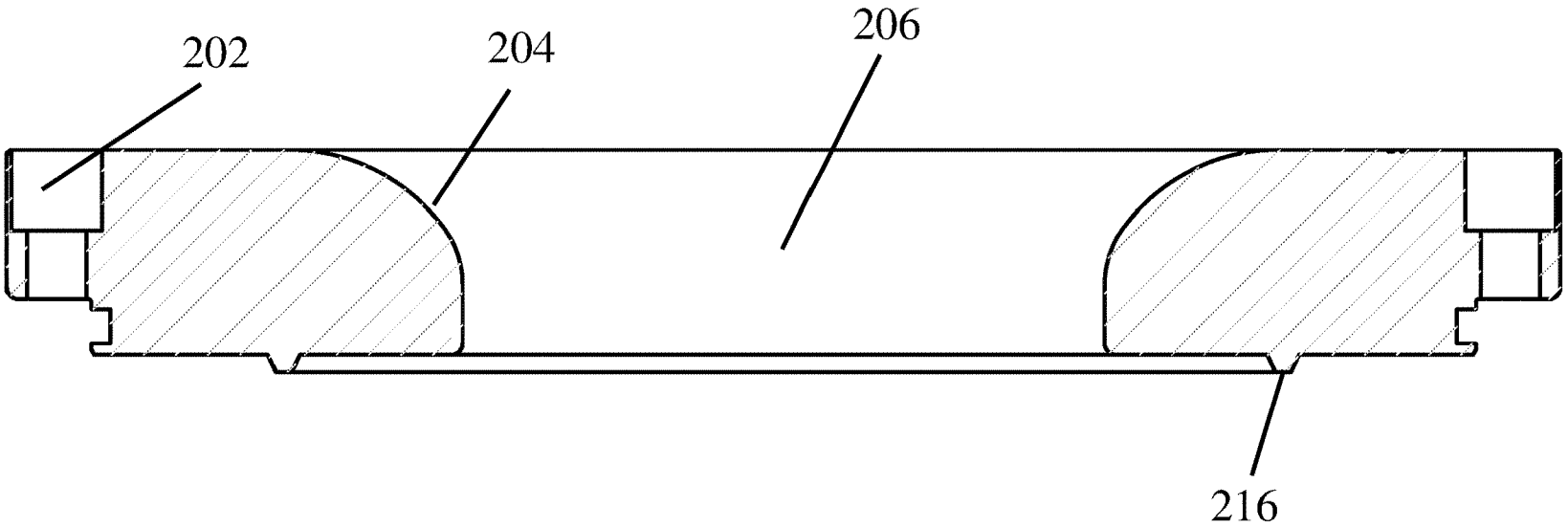
FIG. 15 is a cutaway view thereof.
Figure 16:
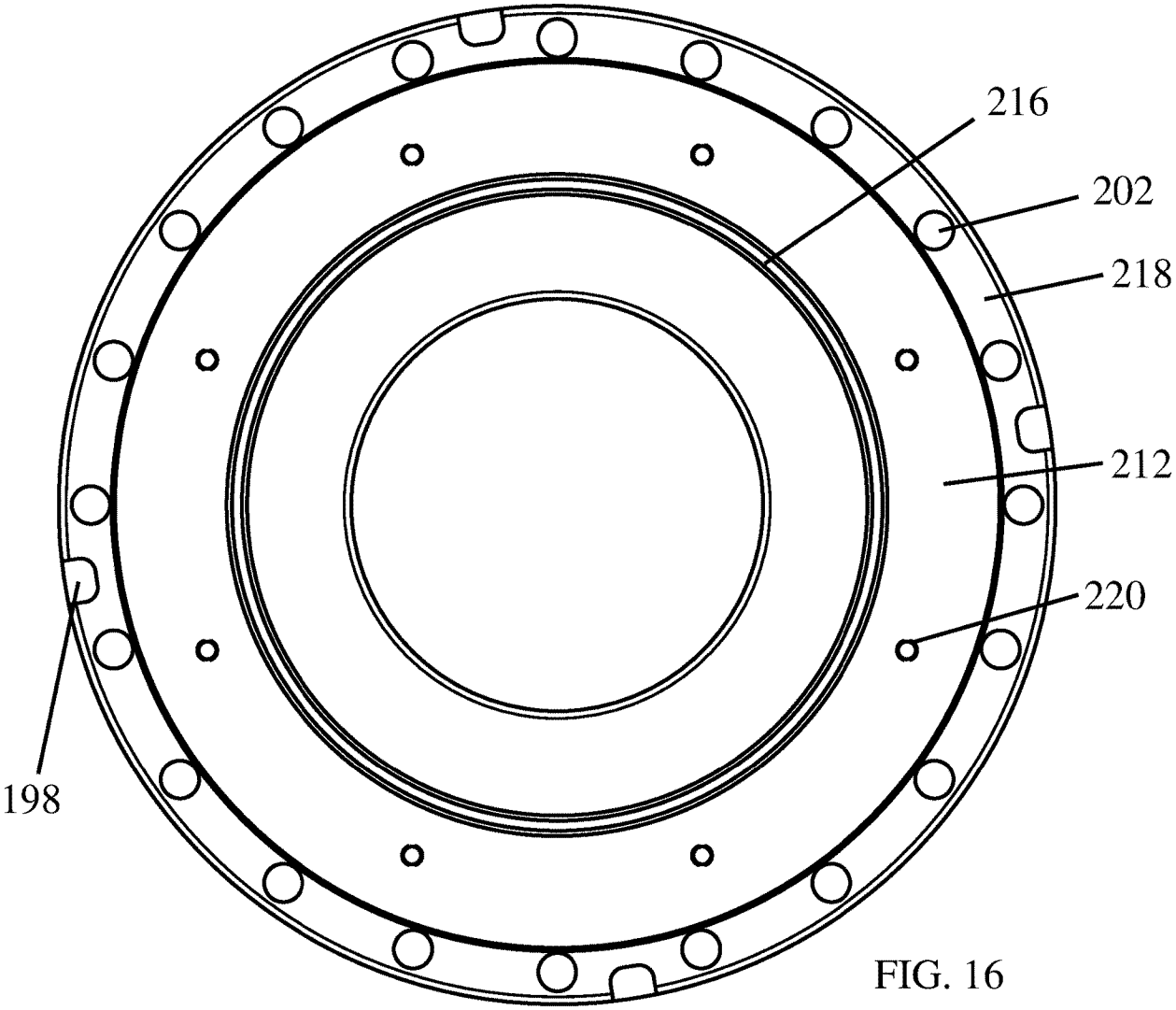
FIG. 16 is a bottom view thereof.

The guide 204, shown in FIG. 15, directs the mandrel towards aperture 206 into the bore. The guide 204 slopes inward down towards the bore. As the mandrel is inserted into the aperture 206 of the attachment body 200, the guide 204 directs the mandrel downwards to the bore.

The drill string passes through the attachment body 200 and into the bore. The drill string is then stabbed through the rubber 108. The contact of the drill string with the rubber 108 assists with rotating the inner barrel.

Referring to FIGS. 2, 16-18, and 20, housing 106 and rubber 108 secure to the bottom side of attachment body 200. The housing contact 218 found on the exterior portion of the bottom side of attachment body 200 enables attachment of the attachment body 200 to housing 106. As described above, fasteners 116 secure the attachment body 200 to housing 106. Fasteners 116 pass through attachment apertures 202 to secure within attachment apertures 120 of housing 106.

The bottom side of attachment body 200 also provides a stripper receiver 212 found on the bottom side of the attachment body 200 for attaching rubber 108 to attachment body 200. Stripper receiver 212 is located inward from the housing contact 218. In one embodiment, stripper receiver 212 extends below housing contact 218. Seal receiver 214 extends below the housing contact 218 for placement of the stripper receiver 212 within housing 106 when attachment body 200 attaches to housing 106.

Seal receiver 214 also assists with the installation of attachment body 200 within housing 106. In one embodiment, stripper receiver 212 extends up to one inch below housing contact 218.

Stripper receiver 212 of attachment body 200 secures rubber 108 to the attachment body 200. Stripper receiver 212 positions rubber 108 within housing 106 to seal the housing 106. Fasteners 222, such as dowels, secure attachment body 200 to rubber 108. Other known fasteners may be used to secure rubber 108 to attachment body 200. Fasteners 222 align rubber 108 on stripper receiver 212 of attachment body 200 for sealing the drilling assembly. The attachment of rubber 108 on attachment body 200 by fasteners 222 also rotates rubber 108 with attachment body 200. In one embodiment of the present invention, 8 0.625 dowels locate rubber 108 on attachment body 200.

A seal, such as an o-ring, may be placed around stripper receiver 212 on seal receiver 214. Seal receiver 214 extends downwards into housing 106 such that the o-ring seals between the stripper receiver 212 and housing 106. The o-ring found on stripper receiver 212 forms a seal in housing 106 above housing lip 146.

Figure 17:
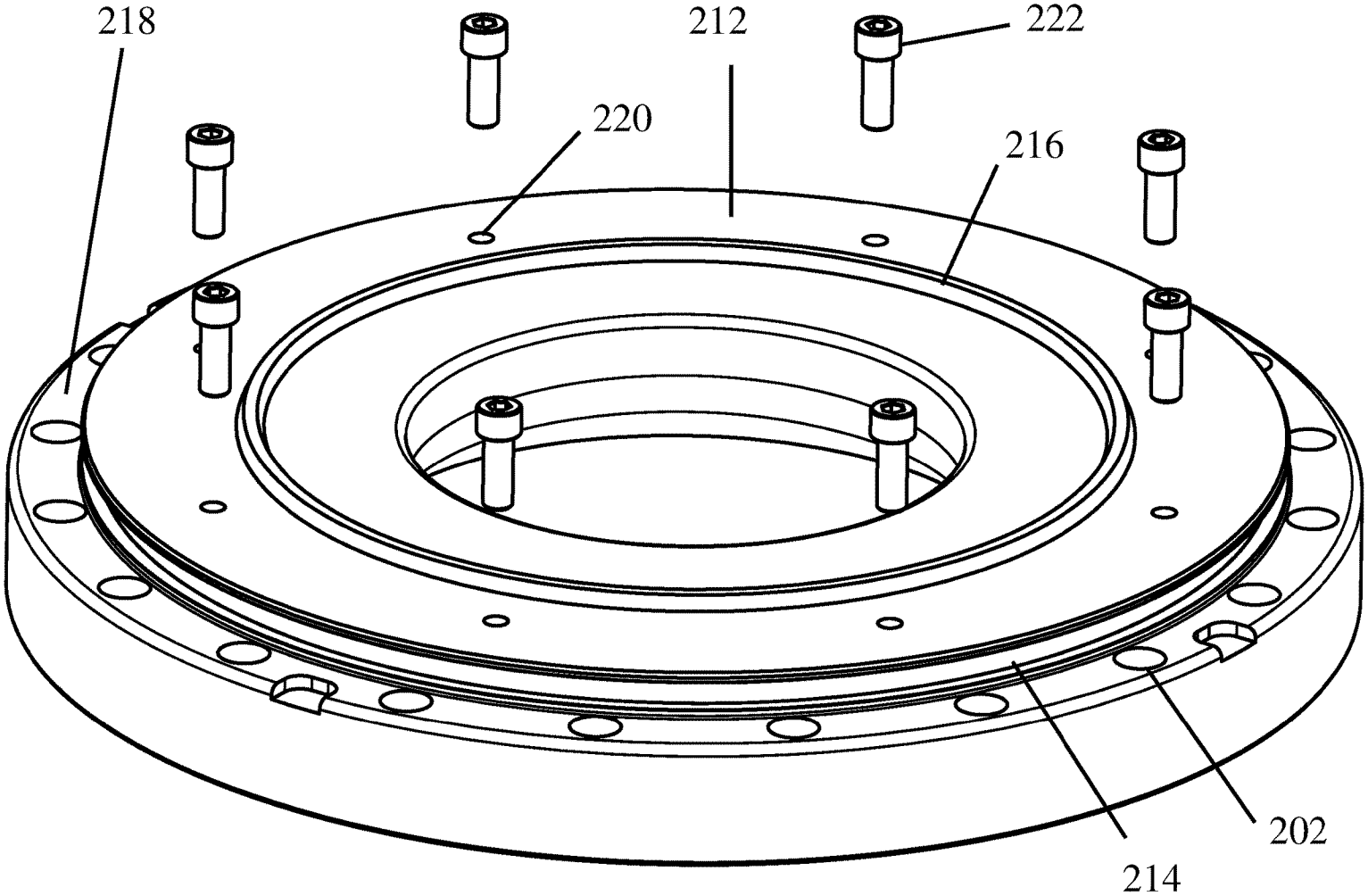
FIG. 17 is a bottom perspective view thereof.
Figure 18:
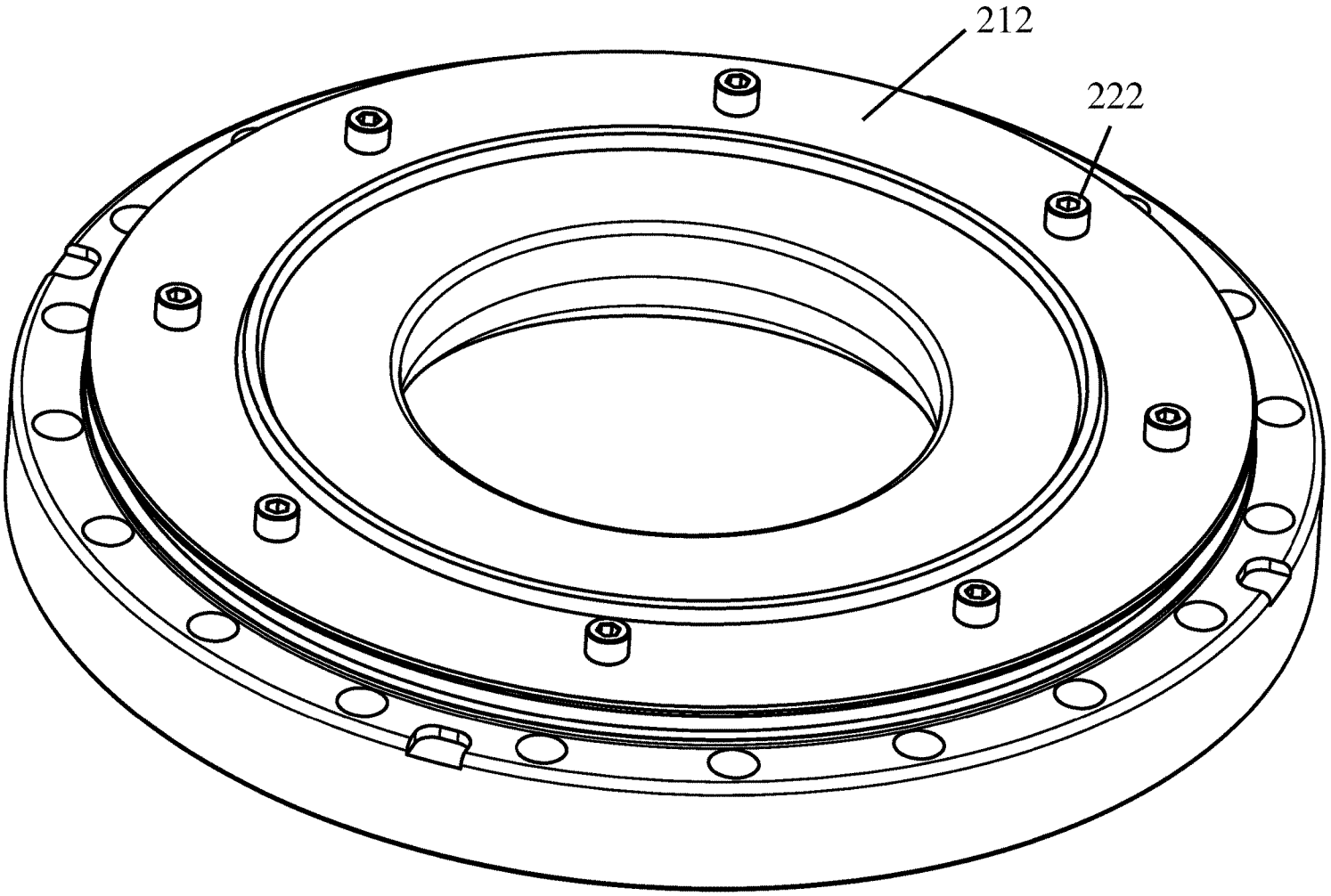
FIG. 18 is a bottom perspective view thereof.

Referring to FIGS. 17, 18, and 20, fasteners 222 align rubber 108 on stripper receiver 212. Fasteners 222 secure into fastener apertures 220 of attachment body 200 and fastener apertures 124 of rubber 108. Attachment body 200 provides sealing lip 216 for contact with sealing lip 140 of rubber 108 shown in FIG. 10. Fasteners 222 align rubber 108 on attachment body 200 such that sealing lip 216 of attachment body 200 aligns with sealing lip 140 of rubber 108. The alignment of sealing lip 216 of attachment body 200 and sealing lip 140 of rubber 108 seals the rubber 108 on stripper receiver 212.

Figure 19:
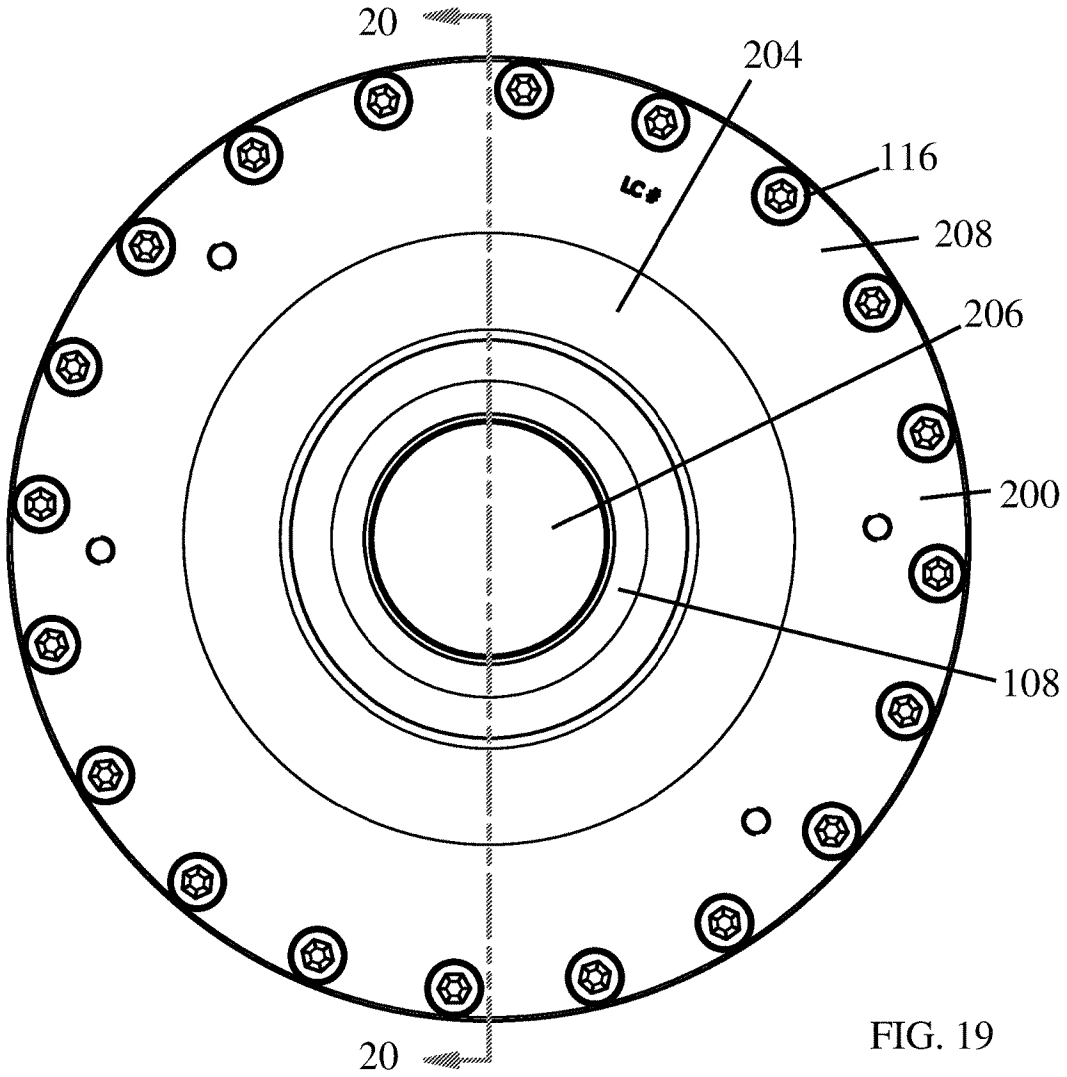
FIG. 19 is a top environmental view thereof.

FIG. 19 shows the attachment body 200 attached to the housing. Fasteners 116 located on the fastener surface 208 insert into fastener apertures 202. Rubber 108 installed on the attachment body 200 enables the mandrel and drilling string to pass through the rubber 108 and attachment body 200 into the bore.

FIG. 20 shows a sectional view of the top pot assembly and the attachment of the components of the top pot assembly. Attachment body 200 provides a fastener surface 208 for accepting fasteners to secure the attachment body 200 with housing 106. Fasteners 116 secure the attachment body 200 to housing 106. Fasteners 116, such as threaded fasteners, screws, bolts, socket head cap screws, or other known fasteners placed into the fastener apertures 202 of fastener surface 208 of attachment body 104 secure attachment body 104 to the housing 106. Fasteners 116 pass into fastener apertures 202 of attachment body 200 to be secured in fastener apertures 120 of housing 106. In one embodiment of the present invention, attachment body 104 secures to a housing 106, such as a top pot.

Housing 106 and rubber 108 secure to the bottom side of attachment body 200. The exterior portion of the bottom side of attachment body 200 provides housing contact 218 for attachment of the attachment body 200 to housing 106. Fasteners 116 pass into attachment apertures 202 to secure within attachment apertures 120 of housing 106.

The bottom side of attachment body 200 also provides a stripper receiver 212 found on the bottom side of the attachment body 200 for attaching rubber 108 to attachment body 200. Stripper receiver 212 is located inward from the housing contact 218. In one embodiment, stripper receiver 212 extends below housing contact 218. Seal receiver 214 extends below the housing contact 218 for placement of the stripper receiver 212 within housing 106 when attachment body 200 attaches to housing 106. Seal 224 located at seal receiver 214 seals the top pot assembly between the housing 106 and attachment body 200.

Rubber 108 secures to the stripper receiver 212 of attachment body 200. Fasteners 222, such as dowels, secure attachment body 200 with rubber 108. Fasteners 222 secure into fastener apertures 220 of attachment body 200 and fastener apertures 124 of rubber 108 to attach attachment body 104 to rubber 108.

FIGS. 3-5 and 20 show the attachment of housing 106 to inner barrel 96. The attachment of the components of the top pot assembly 100 with the inner barrel 96 rotates the rubber and the other components of the top pot assembly with the inner barrel 96. Therefore, inner barrel 96 rotates with the top pot assembly.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An apparatus for securing a rubber within a rotating housing of a drilling assembly, the drilling string passing through the housing along a vertical axis, the apparatus comprising:

an attachment body that attaches to the housing to secure the rubber within the housing, the attachment body having a top surface, a bottom surface, an interior edge, and an outer edge;

a central aperture of the attachment body allowing passage of the drilling string vertically through the attachment body, the interior edge of the attachment body located adjacent the central aperture;

an outer fastener aperture located interior of the outer edge of the attachment body, the outer fastener aperture vertically accepting at least one fastener to attach the attachment body to the housing to enable the housing to rotate with the attachment body;

an inner fastener aperture located on the bottom surface of the attachment body, the inner fastener aperture located radially inward from the outer fastener aperture wherein the inner fastener aperture accepts at least one fastener to secure the rubber with the attachment body; and a sealing lip protruding vertically downward from the bottom surface of the attachment body wherein the sealing lip is located laterally between the inner fastener aperture and the central aperture, wherein the sealing lip is located laterally outward from the interior edge of the attachment body, the sealing lip located vertically below the bottom surface of the attachment body adjacent the interior edge, wherein the sealing lip directly engages the rubber.

2. The apparatus of claim 1 further comprising:

a stripper receiver of the attachment body wherein the rubber attaches to the attachment body at the stripper receiver;

the inner fastener aperture located on the stripper receiver.

3. The apparatus of claim 2 further comprising:

a housing contact surface of the bottom side of the attachment body, the housing contact surface located radially outward from the stripper receiver, the housing contact surface located vertically above the stripper receiver.

4. The apparatus of claim 3 wherein the outer fastener aperture passes through the housing contact surface.

5. The apparatus of claim 3 wherein the sealing lip extends downward from said stripper receiver wherein said sealing lip on said stripper receiver is located radially inward from the inner fastener aperture towards the central aperture, said sealing lip of the stripper receiver extending vertically below the stripper receiver to directly contact a top surface of the rubber to seal between the stripper receiver and the rubber.

6. The apparatus of claim 2 wherein the stripper receiver is located radially inward from the outer fastener aperture, the stripper receiver extending vertically below the outer fastener aperture, the stripper receiver having an outer edge located horizontally inward from the outer fastener aperture, said stripper receiver receiving the rubber for securing the rubber with the attachment body at the stripper receiver.

7. The apparatus of claim 1 wherein the inner fastener aperture terminates prior to reaching the top surface of the attachment body.

8. The apparatus of claim 1 further comprising:

a guide sloping vertically downward at the central aperture of the attachment body wherein the guide forms a convex curve extending downward at a radially interior section of the attachment body.

9. The apparatus of claim 8 further comprising:

a diameter of the central aperture wherein the diameter of the central aperture decreases as the central aperture extends vertically downwards.

10. The apparatus of claim 1 further comprising:

a seal located laterally outward from the inner fastener aperture wherein the seal is located between the inner fastener aperture and the outer fastener aperture, the seal located vertically below the outer fastener aperture.

11. An apparatus for securing a rubber within a rotating housing of a drilling assembly, the drilling string passing through the housing along a vertical axis, the apparatus comprising:

an attachment body that attaches to the housing to secure the rubber within the housing, the attachment body having a top surface, a bottom surface, an interior edge, and an outer edge;

a central aperture of the attachment body allowing passage of the drilling string vertically through the attachment body;

the interior edge of the attachment body located adjacent the central aperture;

an outer fastener aperture located interior of the outer edge of the attachment body, the outer fastener aperture vertically accepting at least one fastener to attach the attachment body to the housing to enable the housing to rotate with the attachment body;

an inner fastener aperture located on the bottom surface of the attachment body, the inner fastener aperture located radially inward from the outer fastener aperture wherein the inner fastener aperture accepts at least one fastener to secure the rubber with the attachment body;

a sealing lip protruding vertically downward from the bottom surface of the attachment body wherein the sealing lip is located laterally between the inner fastener aperture and the central aperture, wherein the sealing lip is located laterally outward from the interior edge of the attachment body, the sealing lip located vertically below the bottom surface of the attachment body located between the sealing lip and the interior edge, wherein the sealing lip directly engages the rubber.

12. The apparatus of claim 11 wherein the size of the central aperture decreases as the central aperture extends vertically downward.

13. The apparatus of claim 11 further comprising:

a stripper receiver of the attachment body wherein the rubber attaches to the attachment body at the stripper receiver;

the inner fastener aperture located on the stripper receiver.

14. The apparatus of claim 13 wherein the stripper receiver is located radially inward from the outer fastener aperture, the stripper receiver extending vertically below the outer fastener aperture, the stripper receiver having an outer edge located horizontally inward from the outer fastener aperture, said stripper receiver receiving the rubber for securing the rubber with the attachment body at the stripper receiver.

15. The apparatus of claim 14 further comprising:

a housing contact surface of the bottom side of the attachment body, the housing contact surface located radially outward from the stripper receiver, the housing contact surface located vertically above the stripper receiver.

16. The apparatus of claim 14 wherein the sealing lip extends downward from said stripper receiver wherein said sealing lip on said stripper receiver is located radially inward from the inner fastener aperture towards the central aperture, said sealing lip of the stripper receiver extending vertically below the stripper receiver to directly contact a top surface of the rubber to seal between the stripper receiver and the rubber.

17. The apparatus of claim 11 further comprising:

a seal located laterally outward from the inner fastener aperture wherein the seal is located between the inner fastener aperture and the outer fastener aperture, the seal located vertically below the outer fastener aperture wherein the seal seals a radial edge of the attachment body to seal the radial edge of the attachment body.

18. An apparatus for securing a rubber within a rotating housing of a drilling assembly, the drilling string passing through the housing along a vertical axis, the apparatus comprising:

an attachment body that attaches to the housing to secure the rubber within the housing, the attachment body having a top surface, a bottom surface, an interior edge, and an outer edge;

a central aperture of the attachment body allowing passage of the drilling string vertically through the attachment body;

the interior edge of the attachment body located adjacent the central aperture;

an outer fastener aperture located interior of the outer edge of the attachment body, the outer fastener aperture vertically accepting at least one fastener to attach the attachment body to the housing to enable the housing to rotate with the attachment body;

an inner fastener aperture located on the bottom surface of the attachment body, the inner fastener aperture located radially inward from the outer fastener aperture wherein the inner fastener aperture accepts at least one fastener to secure the rubber with the attachment body;

a sealing lip of the attachment body, the sealing lip protruding vertically downward from the bottom surface of the attachment body, wherein the sealing lip directly engages the rubber, the sealing lip located laterally outward from the interior edge wherein the sealing lip is located vertically below the bottom surface located between the sealing lip and the interior edge.

19. The apparatus of claim 18 further comprising:

a seal located laterally outward from the inner fastener aperture wherein the seal is located between the inner fastener aperture and the outer fastener aperture, the seal located vertically below the outer fastener aperture wherein the seal seals a radial edge of the attachment body to seal the radial edge of the attachment body wherein the seal is located vertically between the lowest most point of the inner fastener aperture and the outer fastener aperture.

20. The apparatus of claim 18 further wherein the inner fastener aperture accepts a dowel to secure the rubber to the attachment body.

* * * * *